US005575663A

United States Patent [19]

Broschard, III et al.

[11] Patent Number: 5,575,663

[45] Date of Patent: Nov. 19, 1996

[54] ELECTRICAL CONNECTOR FOR MOUNTING TO AN EDGE OF A CIRCUIT BOARD

[75] Inventors: John L. Broschard, III, Hershey; Robert S. Correll, Jr., Harrisburg, both of Pa.

[73] Assignee: The Whitaker Corporation, Wilmington, Del.

[21] Appl. No.: 346,050

[22] Filed: Nov. 29, 1994

[51] Int. Cl.[6] ..... H01R 9/09; H01R 9/16

[52] U.S. Cl. ..... 439/79; 439/567

[58] Field of Search ..... 439/79, 567, 571, 439/572

[56] References Cited

U.S. PATENT DOCUMENTS

| | | | |
|---|---|---|---|
| 3,902,777 | 9/1975 | Anhalt et al. | 439/571 |
| 4,645,287 | 2/1987 | Olsson | 439/571 |
| 4,668,040 | 5/1987 | Matsuzaki et al. | 439/571 |
| 4,681,389 | 7/1987 | Nakazawa et al. | 439/557 |
| 4,915,655 | 4/1990 | Tanaka | 439/67 |
| 5,035,641 | 7/1991 | Van-Santbrink et al. | 439/329 |
| 5,076,804 | 12/1991 | Bertho et al. | 439/867 |
| 5,135,412 | 8/1992 | Sitzler | 439/567 |
| 5,154,634 | 10/1992 | Brown et al. | 439/553 |
| 5,186,633 | 2/1993 | Mosser, III | 439/79 |
| 5,213,515 | 5/1993 | Ishikawa et al. | 439/79 |
| 5,228,870 | 7/1993 | Gorenc et al. | 439/567 |
| 5,238,413 | 8/1993 | McCaffrey et al. | 439/79 |
| 5,334,049 | 8/1994 | Kachlic et al. | 439/567 |

*Primary Examiner*—Gary F. Paumen

[57] ABSTRACT

An electrical connector (10) for mounting to the edge (70) of a circuit board (24) in disclosed. Two metal clips (30) are utilized to both position the connector on the circuit board and to hold it in place until the connector leads (16, 18) are soldered in place. Each of the clips (30) includes a shank (34) that is in interfering engagement with an opening in the connector housing (12), a pair of mutually perpendicular abutting surfaces (48, 50) that locate against a major surface (62) of the circuit board (24) and an edge (70) thereof, and a beam (42) having a free end (44) that engages a hole (60) in the circuit board. When the free ends (44) of the two clips (30) are inserted into the two holes in the circuit board, and the connector (10) pivoted into place, the connector is held in position against the major surface (62), adjacent the edge (70) of the circuit board.

9 Claims, 4 Drawing Sheets

ELECTRICAL CONNECTOR FOR MOUNTING TO AN EDGE OF A CIRCUIT BOARD

The present invention is related to card edge mounted electrical connectors and more particularly to a clip for positioning and holding such a connector against a major surface and adjacent an edge of a circuit board.

BACKGROUND OF THE INVENTION

Electrical connectors for mounting to circuit boards, typically have contact leads that extend through plated through holes or have leads that engage contact pads on the surface of the circuit board. Locating pins or posts are usually molded into the housing and arranged to enter into holes in the circuit board for accurately positioning the connector. These locating posts, sometimes will include features that will grip the circuit board to hold the connector in place. Mounting clips can also be used to both locate and to hold the connector in place on the circuit board. Such a connector is disclosed in U.S. Pat. No. 4,645,287 which issued Feb. 24, 1987 to Olsson. The '287 patent discloses an electrical connector having surface mount contact leads that engage contact pads on the surface of the circuit board. The connector housing has a U-shaped groove formed adjacent each end for receiving a U-shaped clip that is closely received within the groove. The two clips have ends that extend into holes in the circuit board for both locating the connector with respect to the contact pads and for holding the connector to the surface of the circuit board. This type connector requires mounting space on the surface of the circuit board that is equal to the size of the connector, and requires separate U-shaped clips that must be assembled when mounting the connector to a circuit board. In certain cases such connectors can be mounted to the edge of a circuit board, thereby saving board surface area for other board mounted components. Electrical connectors that are mounted to the edge of a circuit board, typically, utilize pins that are molded into the connector housing to enter into holes in the circuit board to accurately locate the connector so that the contact leads match up with their respective contact pads or plated through holes in the circuit board. Additionally, spring clips, or similar devices, enter into other holes in the circuit board for holding the connector housing against the surface of the circuit board. Such an electrical connector is disclosed in U.S. Pat. No. 5,334,049 which issued Aug. 2, 1994 to Kachlic et al. The '049 patent discloses an electrical connector having an insulating housing that includes a pair of flanges that rest on the surface of the circuit board. A locating pin extends from each flange into a respective hole in the circuit board for positioning the connector. Each flange has a cavity containing a hold down spring clip that includes a barbed portion that extends into a hole in the circuit board. The spring clip is deflected toward the circuit board when it is inserted into the hole so that there is a continuing force tending to urge the flanges of the connector housing into engagement with the surface of the circuit board. While this type of connector requires less circuit board surface area for mounting, it nevertheless requires some space for the flanges, and requires both locating pins and spring hold down clips to effect a proper mounting.

What is needed is an electrical connector that easily mounts to the edge of a circuit board without the connector housing requiring mounting area on its surface, and without the need for separate clips or other parts to effect the mounting. Ideally, a single mechanism will serve to both position the connector and secure it to the circuit board for soldering.

SUMMARY OF THE INVENTION

An electrical connector is disclosed for mounting to an edge of a circuit board. The connector includes a housing and a plurality of electrical contacts contained therein, each contact having a solder tail arranged to engage a respective contact pad on a major surface of the circuit board. A clip is provided for accurately positioning and holding the connector against the major surface adjacent the edge so that the solder tails are in engagement with their respective contact pads. The clip includes a body having a first surface for engaging the major surface of the circuit board, the first surface defining a plane. A shank extends from the body in a first direction and is in interfering engagement with an opening in the connector housing. The clip includes a first beam extending from the body in a second direction opposite the first direction on one side of the plane and a second beam extending from the first beam in cantilever fashion and having a free end on a side of the plane opposite the one side.

The circuit board has a hole through its major surface that is spaced from the edge. The free end of the second beam is adapted to extend into the hole and the first and second beams are adapted to urge the connector against the major surface adjacent the edge.

DESCRIPTION OF THE PREFERRED EMBODIMENT

Figure 3:
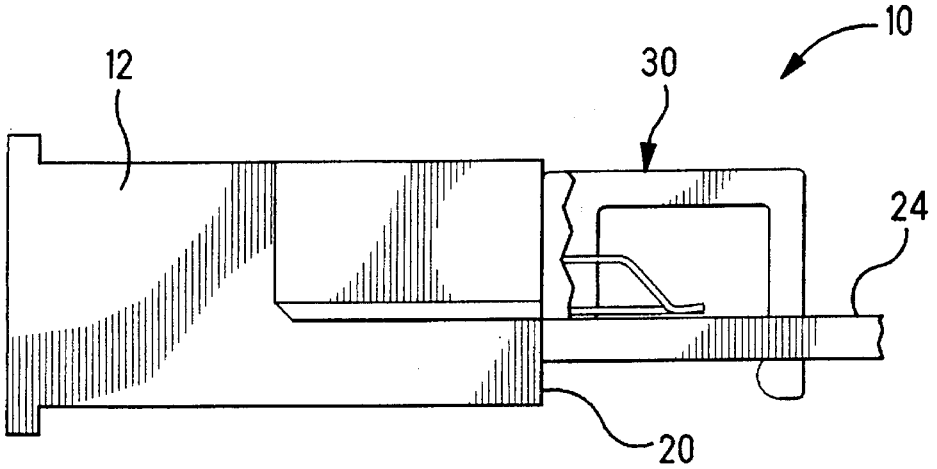
Figure 4:
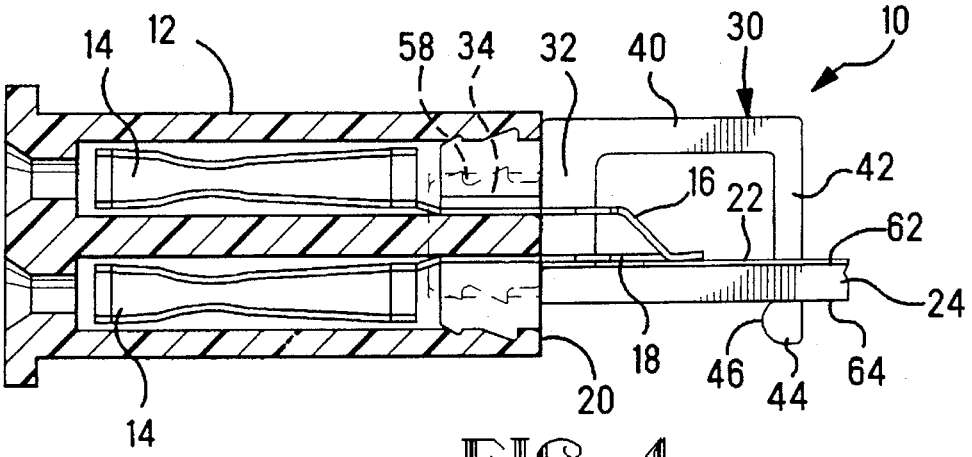
FIG. 4 is cross/sectional view taken along the lines 4—4 of FIG. 2.
Figure 6:
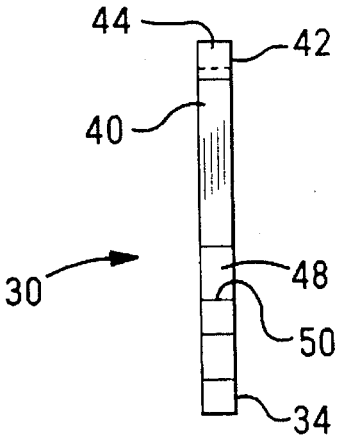
FIGS. 5 and 6 are front and side views, respectively, of the clip shown in FIG. 1.
Figure 5:
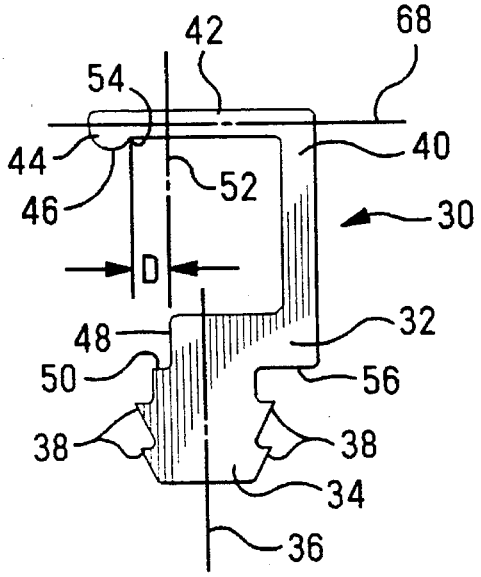

There is shown in FIGS. 1, 2, 3, and 4 an electrical connector 10 having an insulating housing 12 and a plurality of electrical contacts 14 arranged in cavities within the housing. The contacts have leads or solder tails 16 and 18 extending outwardly from a rear face 20 of the housing 12, as best seen in FIGS. 3 and 4. The solder tails are spaced to engage respective contact pads 22 on a circuit board 24 when the connector is mounted thereto, as will be explained below. Two clips 30 extend outwardly from the rear face 20 of the housing 12. As best seen in FIGS. 5 and 6, each clip includes a body 32 and a shank 34 extending from the body, the shank having a longitudinal centerline 36. The shank includes barbs 38 that extend outwardly from each side of the shank. A first beam 40 extends from the body 32 on one side of the centerline 36 in a direction that is substantially parallel to the centerline. A second beam 42 extends from the first beam 40 in cantilever fashion and has a free end 44 that is disposed on a side of the centerline 36 that is opposite to the first beam. A radiused projection 46 extends from the free end 44 generally toward the shank 34 for a purpose that will be explained. First and second mutually perpendicular abutting surfaces 48 and 50, respectively, are formed on an edge of the body 32 opposite the first beam 40. The first abutting surface 48 is substantially parallel to the centerline 36 and is arranged so that a plane 52 defined by the first abutting surface is disposed between the projection 46 and the first beam 40, and the distance D between the plane and the upper most edge 54 of the projection 46 is equal to or less than the thickness of the circuit board 24. Further, the center line 36 and the first abutting surface 48 are spaced apart a specific distance so that the contact surfaces of the solder tails 16 and 18 are in proper engagement with their respective contact pads 22 when the connector 10 is in the position shown in FIG. 4. An edge 56 of the body 32 is coplanar with the second abutting surface 50.

Figure 1:
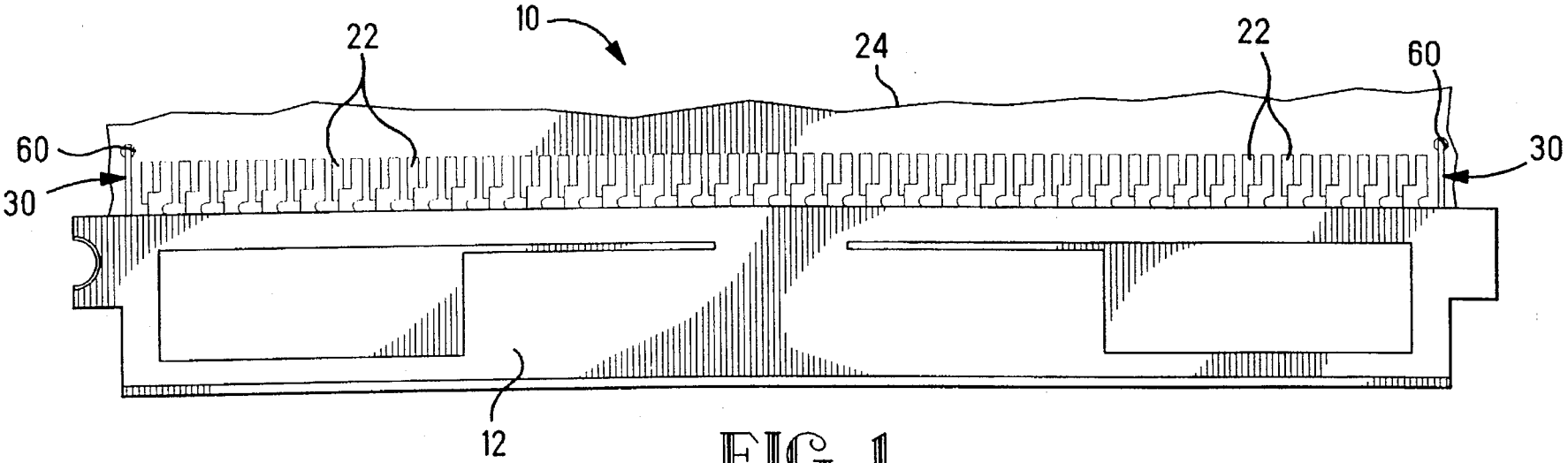
FIGS. 1, 2 and 3 are top, front, and end views, respectively, of a circuit board mounted connector incorporating the teachings of the present invention.
Figure 2:
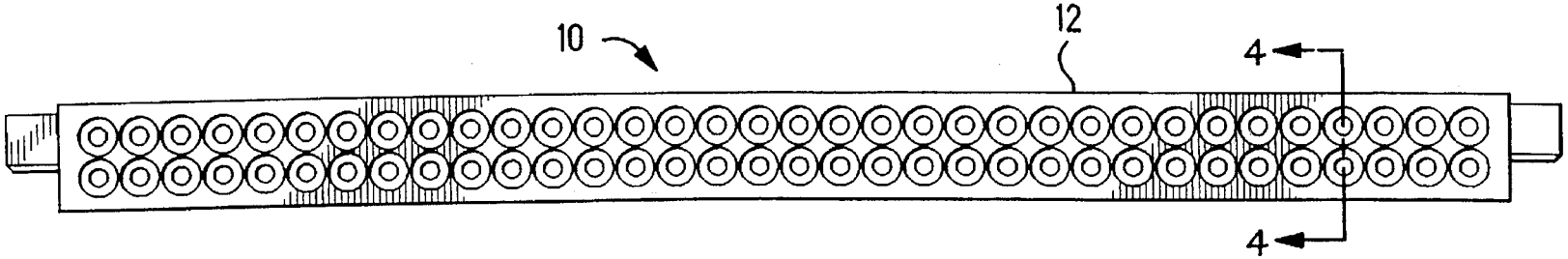
Figure 9:
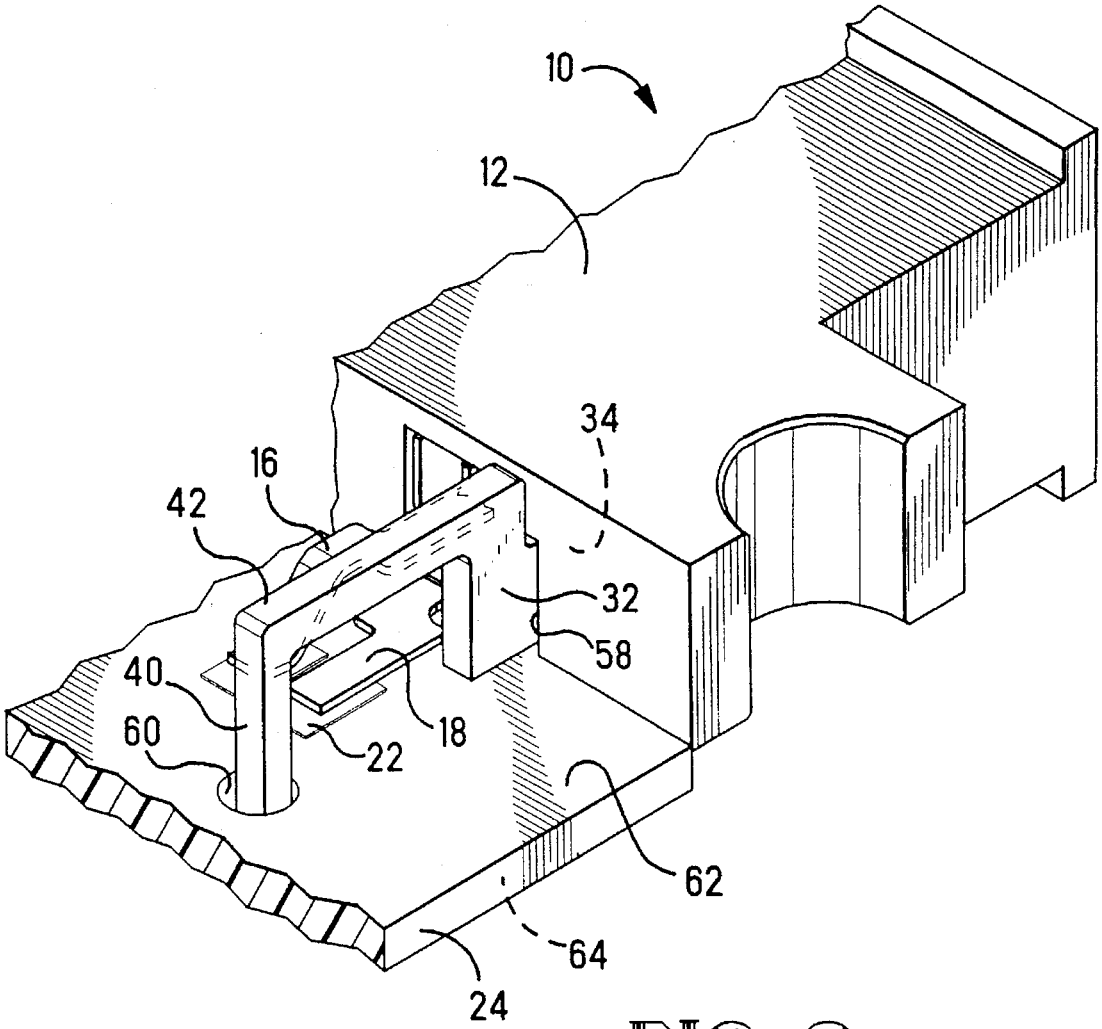
FIG. 9 is an isometric view of a portion of the connector shown in FIG. 1.

Each of the clips 30 is assembled to the connector housing 12 by forcing the shank 34 into an opening 58 in the housing, as best seen in FIGS. 4 and 9, that is sized for an interference fit. The shank is pressed into the opening until the edge 56 engages the rear face 20 of the housing and the second abutting surface 50 is flush with the rear face. The barbs 38 dig into the side walls of the opening to secure the shank therein, as shown in FIG. 4. As shown in FIG. 6, the clip 30 is substantially flat, with the body 32, shank 34, and the first and second beams 40 and 42 all being in a common plane. Such a structure is easily stamped and requires no forming operation, therefore, is relatively inexpensive to manufacture. The clip 30 is made out of any suitable spring material such a phosphorous bronze or stainless steel. As shown in FIG. 1, the circuit board 24 includes two holes 60, which may be plated through holes, for receiving the free ends 44 of the two clips 30. Each hole 60 extends through a major surface 62, completely through the circuit board, and through an opposite surface 64. The two holes 60 are spaced apart to conform to the spacing of the two clips 30 and are sized so that the free ends 44 and the projections 46 of the clips will easily slip into and through the holes. Each of the second beams has a longitudinal axis 68, as seen in FIG. 5, that is spaced from the second abutting surface 50 by an amount that is equal to or less than the distance from the center of one of the holes 60 to an edge 70 of the circuit board. This assures that when the connector is assembled to the circuit board, as shown in FIG. 4, there is a snug fit between the rear face 20 of the housing and the edge 70, and between the hole 60 and the projection 46.

Figure 7:
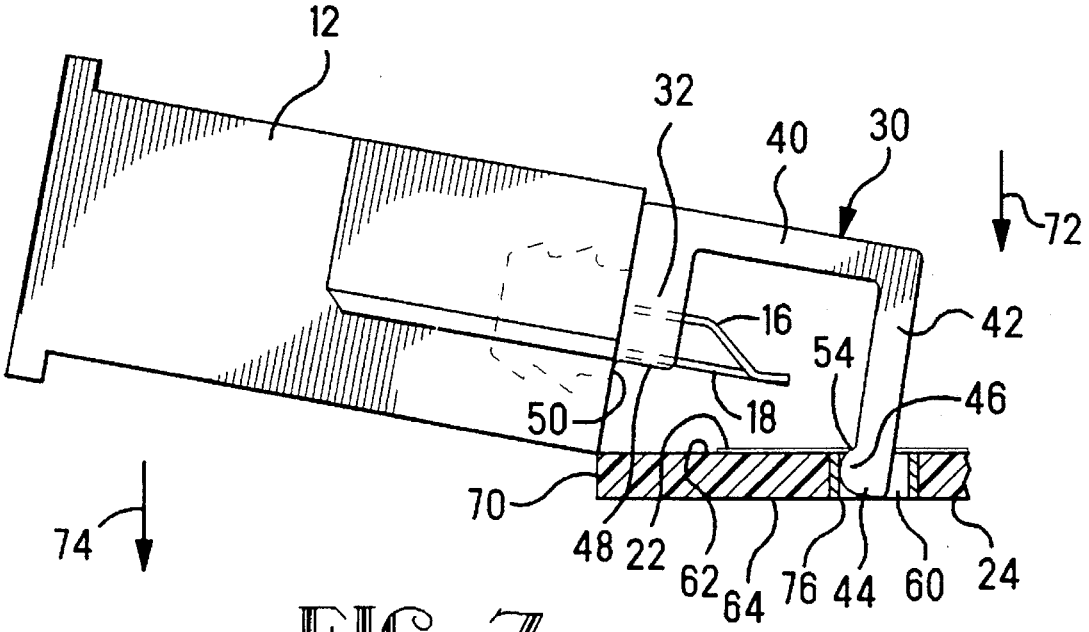
FIGS. 7 and 8 are enlarged views of the connector shown in FIG. 3 showing its assembly to a circuit board.
Figure 8:
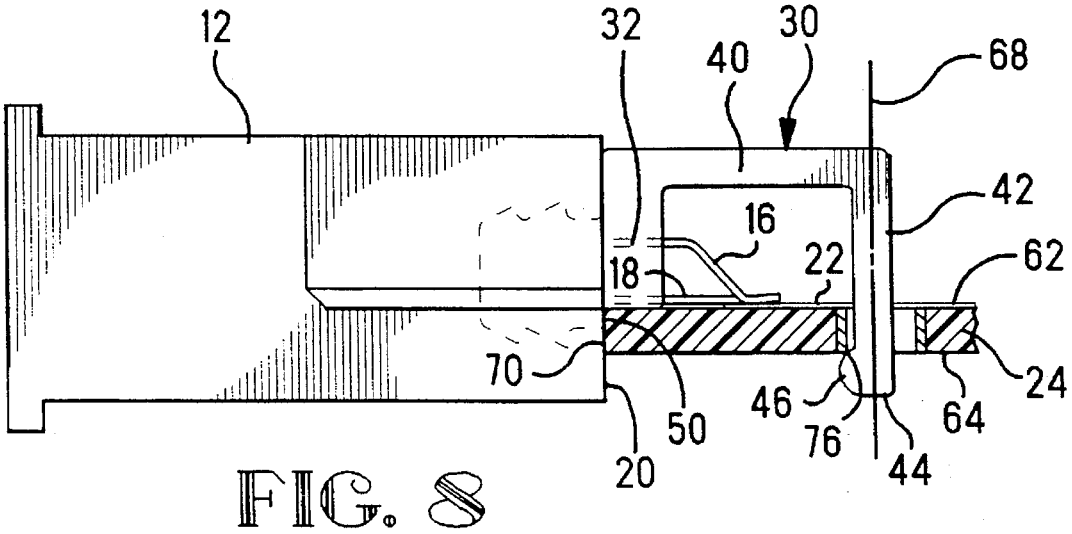

To assemble the connector 10 to the circuit board 24, the connector may be tilted slightly, as shown in FIG. 7, and the free ends 44 inserted into the holes 60. The second beams 42 are moved in the direction of the arrow 72 until the projections 46 are substantially through their respective holes. The connector 10 is then pivoted counterclockwise, in the direction of the arrow 74 as viewed in FIG. 7, until the first abutting surface 48 engages the major surface 62 of the circuit board, as shown in FIG. 8. The connector 10 is held snugly in this position by the radiused surface of the projection 46 being in engagement with a corner 76 formed by an edge of the hole 60 and the surface 64 of the circuit board. In the event that the spacing of the hole 60 from the edge 70 is slightly greater than the distance between the axis 68 and the second abutting surface 50, the first and second beams 40 and 42 will elastically deflect as the free end 44 is inserted into the hole 60. This will provide a snapping action as the connector is pivoted downwardly in the direction of the arrow 74, as shown in FIG. 7, to the position shown in FIG. 8, where the first and second abutting surfaces will be urged against the surfaces 62 and 70, respectively, by the resiliency of the first and second beams 40 and 42. The lateral position of the two clips 30 and the holes 60, as viewed in FIG. 1, are chosen so that the solder tails 16 and 18 are in alignment with their respective contact pads 22 when the connector is in position on the circuit board 24, as shown in FIG. 8. After the connector 10 is assembled to the circuit board 24, the connector and circuit board assembly is then subjected to a typical soldering operation where the solder tails 16 and 18 are soldered to their respective contact pads 22. In the event that the holes 60 are through plated holes, the free ends 44 and the second beams 42 of the two clips 30 will be soldered to the metalization of the circuit board, thereby providing substantial physical support of the connector. This will limit adverse loadings on the solder connections between the solder tails 16 and 18 and the contact pads 22.

While, in the present example, the second abutting surface 50 is flush with the rear face 20 of the connector housing, the abutting surface 50 may extend outwardly a substantial distance from the face 20. In this case the second abutting surface 50 will still locate the connector 10 against the edge 70 of the circuit board, although the face 20 will be spaced from the edge.

An important advantage of the present invention is that the two clips align the connector so that the solder tails are in proper engagement with their respective contact pads on the circuit board for soldering, and hold the connector in this position until soldering is complete. This is accomplished without the need of the connector housing occupying mounting area on the surface of the circuit board. Additionally, when the circuit board has plated through holes, the portion of the clips that extend into the holes can be soldered thereto for shifting some of the load forces from the solder tails to the clips.

We claim:

1. In an electrical connector for mounting to an edge of a circuit board, said connector having a housing and a plurality of electrical contacts within said housing, each contact having a solder tail arranged to engage a respective contact pad on a major surface of said circuit board, a clip for accurately positioning and holding said connector against said major surface adjacent said edge so that said solder tails are in engagement with their said respective contact pads, said clip comprising:

(a) a body having a first abutting surface for engaging said major surface, said first abutting surface defining a plane; said body having a second abutting surface substantially perpendicular to said plane and adapted to abuttingly engage said edge of said circuit board when said connector is mounted thereof;

(b) a shank extending from said body in a first direction, said shank in interfering engagement with an opening in said connector housing;

(c) a first beam extending from said body in a second direction opposite said first direction on one side of said plane;

(d) a second beam extending from said first beam in cantilever fashion and having a free end on a side of said plane opposite said one side, said second beam including a projection extending from said free end in a direction generally toward said second abutting surface, wherein said circuit board has a hole through said major surface and spaced from said edge and, said hole in said circuit board extending completely through said circuit board and intersecting a surface opposite said major surface, and wherein said free end adapted to extend through said hole so that said projection engages an edge of said hole adjacent said opposite surface and said first and second beams are adapted to urge said connector against said edge of said circuit board adjacent said major surface.

2. The connector according to claim 1 wherein said first abutting surface is adapted to abuttingly engage said major surface of said circuit board when said connector is mounted thereto and position said solder tails of said connector for said engagement with said respective contact pads, wherein said connector housing is spaced from and adjacent said major surface.

3. The connector according to claim 1 is wherein said second abutting surface substantially flush with a side of said connector housing.

4. The connector according to claim 1 wherein said second beam has a longitudinal axis that is spaced from said second abutting surface a distance that is equal to or less than the distance between said hole and said edge of said circuit board so that when said connector is mounted to said circuit board, said first and second beams urge said second abutting surface into engagement with said edge.

5. The connector according to claim 1 where said projection has a radiused surface that engages a side of said hole in said circuit board when said second beam is inserted into said hole and cams said free end away from said second abutting surface.

6. The connector according to claim 1 wherein said clip is a first clip and said hole in said connector housing containing said shank of said first clip is adjacent one end of said connector housing and said housing includes another hole adjacent the other end thereof containing a shank of a second clip that is substantially identical to said first clip.

7. The connector according to claim 6 wherein said first and second clips are arranged so that when said second beams are inserted into their respective holes in said circuit board and said side of said connector housing is brought into abutting engagement with said edge, said second beams elastically deflect thereby providing a force that urges said side of said connector against said edge.

8. The connector according to claim 1 wherein said clip is a substantially flat sheet metal stamping wherein said body, said shank, and said first and second beams all lie in a common plane.

9. The connector according to claim 1 wherein said shank includes a barb for securing said shank in said opening in said connector housing, said barb extending from said shank in the plane of said shank.

* * * * *